US005810035A

United States Patent [19]

Tekriwal et al.

[11] Patent Number: 5,810,035

[45] **Date of Patent: *Sep. 22, 1998**

[54] NON-SYMMETRIC HEATING ELEMENT/ SPRAY-ARM ALIGNMENT WITHIN A DISHWASHER

[75] Inventors: Prabhat Kumar Tekriwal, Schenectady, N.Y.; Joseph Duane Tobbe, Taylorsville; Andrew Joseph Spanyer, Louisville, both of Ky.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 864,754

[22] Filed: May 29, 1997

Related U.S. Application Data

[63] Continuation of Ser. No. 578,345, Dec. 26, 1995, abandoned.

[51] Int. Cl.[6] ..... A47L 15/42

[52] U.S. Cl. ..... 134/105; 134/176

[58] Field of Search ..... 134/95.2, 102.3, 134/105, 108, 176, 179

[56] References Cited

U.S. PATENT DOCUMENTS

| | | | |
|---|---|---|---|
| 2,981,267 | 4/1961 | Stoddard | 134/108 X |
| 3,064,664 | 11/1962 | Warhus | 134/176 |
| 3,285,779 | 11/1966 | Dunham | 134/176 X |
| 3,951,683 | 4/1976 | Jarvis, Jr. et al. | 134/144 |
| 4,246,916 | 1/1981 | Fay et al. | 134/105 |
| 5,076,306 | 12/1991 | Suzuki et al. | 134/95.2 |
| 5,299,586 | 4/1994 | Jordan et al. | 134/186 X |
| 5,355,900 | 10/1994 | Sakata | 134/95.2 |
| 5,727,581 | 3/1998 | Tekriwal et al. | 134/179 X |

FOREIGN PATENT DOCUMENTS

| | | | |
|---|---|---|---|
| 4225614 | 2/1994 | Germany | 134/105 |

*Primary Examiner*—Philip R. Coe

*Attorney, Agent, or Firm*—Patrick K. Patnode; Marvin Snyder

[57] ABSTRACT

The instant invention is directed in general to dishwashers and, more specifically, to a non-symmetric heating element/ spray-arm alignment within a dishwasher. In a first embodiment of the instant invention, a dishwasher having a washing phase and a drying phase, includes a spray-arm having a center point, rotatably attached within a dishwasher and a heating element having a center point positioned within the dishwasher, where the center point of the heating element and the center point of the spray-arm are offset such that the heating element and the spray-arm are non-symmetrically aligned and the spray-arm is exposed to the heating element in varying regions during drying phases.

1 Claim, 7 Drawing Sheets

NON-SYMMETRIC HEATING ELEMENT/ SPRAY-ARM ALIGNMENT WITHIN A DISHWASHER

This application is a Continuation of application Ser. No. 08/578,345 filed Dec. 26, 1995 now abandoned.

BACKGROUND OF THE INVENTION

The instant invention is directed in general to dishwashers and, more specifically, to a novel non-symmetric heating element/spray-arm alignment within a dishwasher.

Located within almost all dishwashers is a heating element positioned at the bottom of a dishwasher tub. During dishwasher use, a spray-arm spins during washing or rinsing phases and comes to rest during the final drying phase. During this drying phase, a typical spray-arm is subjected to high temperatures from the heating element positioned at the bottom of the dishwasher tub.

Due to the symmetric alignment of heating elements and spray-arms within conventional dishwashers, the same regions of the plastic spray-arm are continuously subjected to the high temperatures of the heating element during the drying phase of operation, regardless of the spray-arm resting orientation. Continuously subjecting the same regions of a spray-arm to the high temperatures produced by the heating element may cause deterioration, fatigue and eventual failure of the spray-arm material.

In order to combat this problem, most current dishwasher spray-arms have a metal heat shield attached to protect the exposed regions of the spray-arm from the harmful heat produced by the heating element. However, a low part count is an important factor in the low-cost production of high quality dishwashers. Removal of the heat shield from the dishwasher spray-arm assembly process would lower raw material costs, hasten assembly time, and provide an overall cost savings to the consumer.

Therefore, it is apparent from the above that there exists a need in the art for preventing regions of a spray-arm surface from being exposed repeatedly to excess amounts of heat from the heating element during dishwasher operation. Additionally, this prevention should be completed without adding parts to the dishwasher assembly, such as a heat shield. It is a purpose of this invention, to fulfill these and other needs in the art in a manner more apparent to the skilled artisan once given the following disclosure.

SUMMARY OF THE INVENTION

The above-mentioned needs are met by the instant invention which relates to a novel alignment of a dishwasher's heating element and spray-arm. More specifically, the instant invention involves a dishwasher having a non-symmetrically aligned heating element and spray-arm.

In a first embodiment of the instant invention, a dishwasher having several washing or rinsing phases and a final drying phase, includes a spray-arm having one or more radially extending wing sections, one or more spray orifices spaced therealong and a central hub, and a heating element non-symmetrically aligned with said spray-arm such that said spray-arm is heated in varying regions depending upon the spray-arms resting orientation.

This non-symmetric alignment of the spray-arm and heating element provides improved reliability and safety over conventional dishwashers. Additionally, the instant invention reduces the likelihood of plastic spray-arm deterioration, fatigue, or failure, thereby improving product quality and reduces part count by removing heat shields from the dishwasher assembly.

The preferred apparatus and method for non-symmetric heating element/spray-arm alignment within a dishwasher, offers the following advantages: improved product quality; reduction of plastic spray-arm deterioration, fatigue and failure; lower dishwasher part count; and improved safety and reliability. In fact, in many of the preferred embodiments, these factors of improved product quality, reduction of plastic spray-arm deterioration, fatigue and failure, lower part count, and improved safety and reliability, are optimized to an extent considerably higher than heretofore achieved in prior, known dishwasher assemblies.

Other objects and advantages of the present invention will become apparent upon reading the following detailed description and the appended claims with reference to the accompanying drawings.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Referring first to FIGS. 1A–1D and 2A–2D of the drawings, schematic illustrations of the top view of conventional dishwasher heating element/spray arm-alignments are shown.

FIGS. 1A–1D and 2A–2D depict heating elements 12 and 112 respectively, aligned and positioned beneath spray arms, 14 and 114, respectively. Most, if not all, dishwashers have a number of washing and rinsing phases and a final drying phase. During a typical washing or rinsing phase, a pump forces washing or rinsing liquid upwardly through a conduit and into the spray-arm. The washing liquid is distributed from the spray-arm by means of orifices spaced therealong. The spray-arm is reactively driven by having at least one of the orifices disposed to discharge a jet stream in a direction such that the spray-arm reacts to the force of the discharge and rotates in a horizontal plane. A thorough and generally uniform distribution of washing or rinsing liquid in the washing tub is thereby obtained. Upon completion of the washing or rinsing phase, the spray-arm stops in varied resting orientations, and the drying phase begins.

As shown in FIGS. 1A–1D and 2A–2D the heating elements, (12 and 112), and the spray-arms, (14 and 114), are aligned symmetrically, with each spray-arm's center point located central to each heating element. This alignment maintains each spray-arm in the same location with respect to the heating element at all times.

These current alignments are problematic because certain regions of the spray-arms, often made of plastic, are overexposed and heated in each drying phase regardless of the spray-arm resting orientation.

This problem can be illustrated with the aid of FIGS. 1A–1D. In resting orientation A of FIG. 1A, overexposed regions, 22 and 24, of the conventional spray-arm are indicated. When spray-arm 14 comes to rest in resting orientation A, overexposed regions 22 and 24 are positioned directly above heating element 12 and are therefore exposed to the extreme temperatures during the dishwasher's drying phase.

Figure 1A:
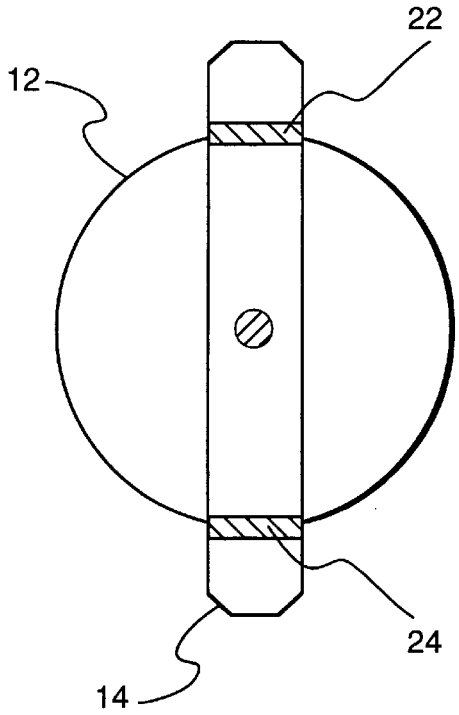
FIG. 1a (PRIOR ART)
FIGS. 1A–1D are schematic illustrations of a top view of a first conventional heating element/spray-arm alignment within a dishwasher assemblage.
Figure 1B:
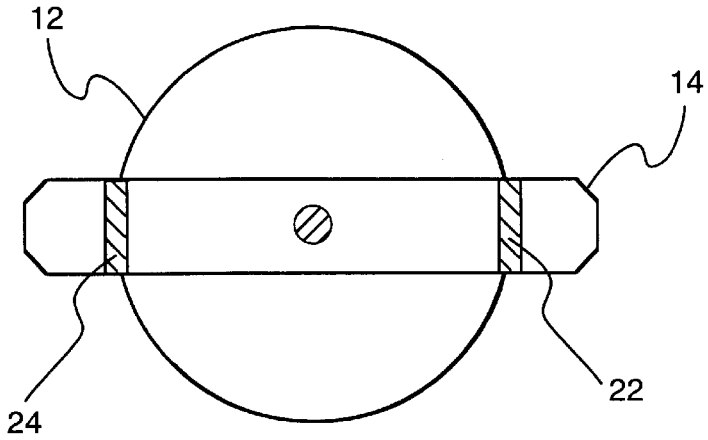
FIG. 1b (PRIOR ART)
Figure 1C:
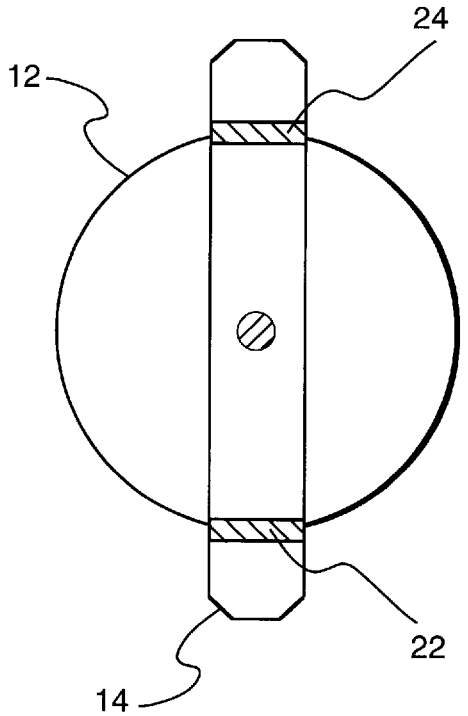
FIG. 1c (PRIOR ART)
Figure 1D:
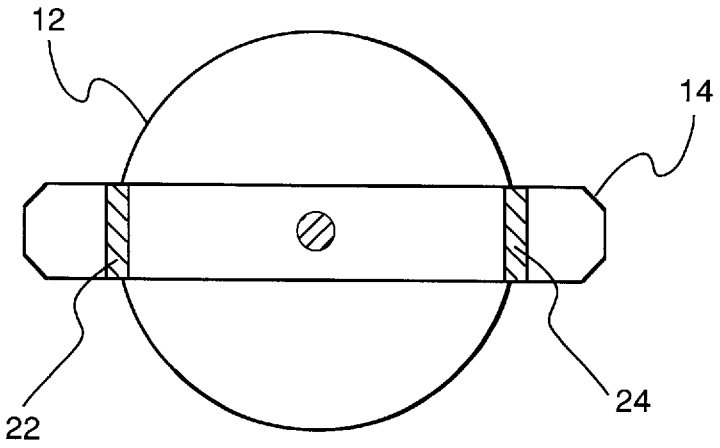
FIG. 1d (PRIOR ART)
Figure 2A:
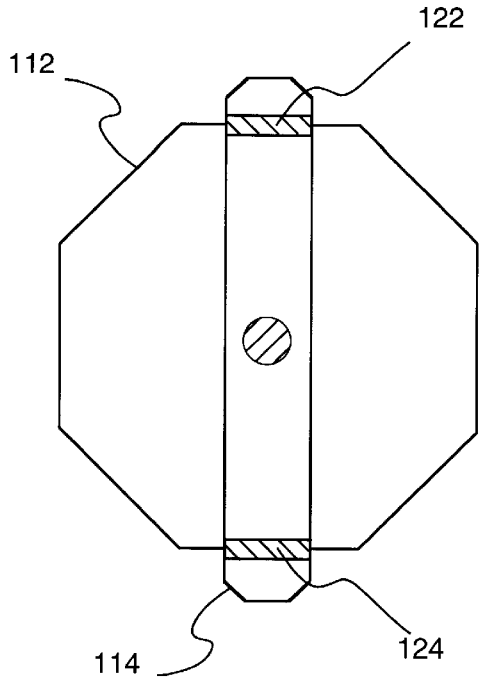
FIG. 2a (PRIOR ART)
FIGS. 2A–2D are schematic illustrations of a top view of a second conventional heating element/spray-arm alignment within a dishwasher assemblage.
Figure 2B:
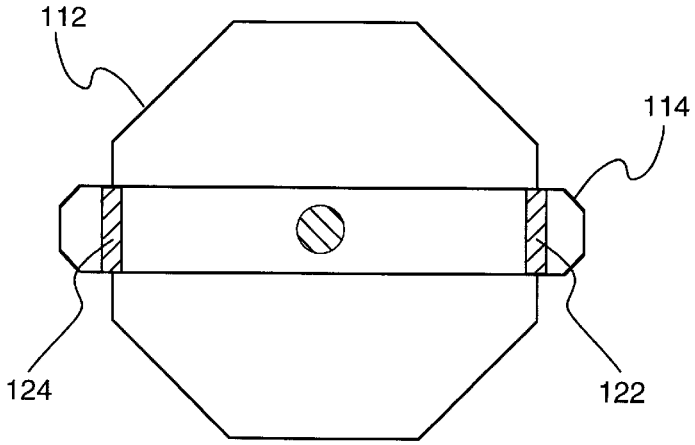
FIG. 2b (PRIOR ART)
Figure 2C:
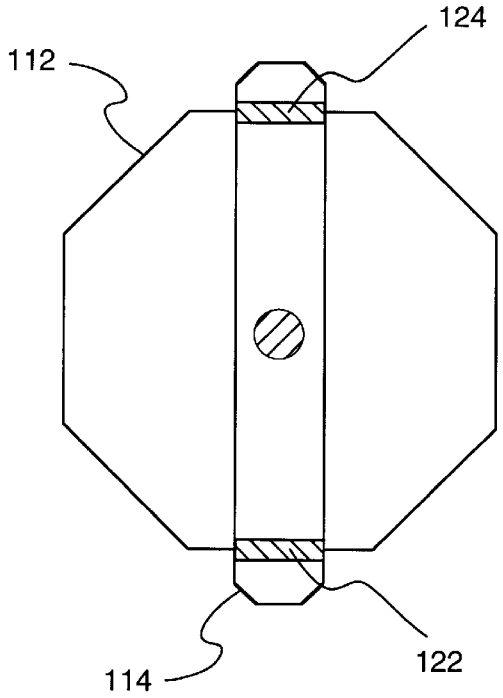
FIG. 2c (PRIOR ART)
Figure 2D:
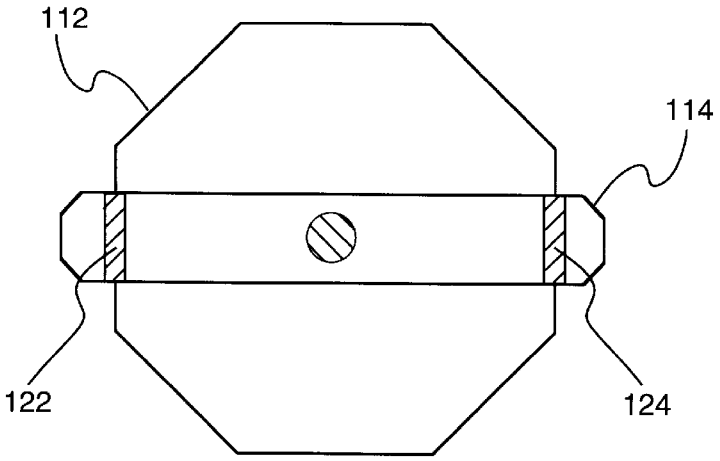
FIG. 2d (PRIOR ART)

In resting orientation B of FIG. 1B, spray-arm 14 is shown rotated 90° clockwise from resting orientation A. However, overexposed regions, 22 and 24, continue to be the regions of spray-arm 14 positioned directly above heating element 12. Accordingly, overexposed regions, 22 and 24, are again subjected to the high temperatures of heating element 12.

Resting orientations C (90° clockwise form B) and D (90° clockwise from C) reveal that overexposed areas, 22 and 24, will always be positioned directly above heating element 12, continuously subjecting these regions to the high temperatures produced by heating element 12, regardless of the ultimate resting orientation of spray-arm 14.

This pattern of continuously subjecting the same regions of a spray-arm to the high temperatures produced by the heating element ultimately causes deterioration, fatigue and failure of the spray-arm material, often plastic.

Now referring to FIGS. 3A–3D of the drawings a series of schematic illustrations of a top view of a non-symmetric heating element/spray-arm alignment, according to the instant invention are shown. FIGS. 3A–3D depict a heating element 212, positioned beneath a spray-arm 214, having one or more radially extending wing sections, often a first wing section 216 and a second wing section 218, and a central hub 220. One or more spray orifices 221 are formed within spray-arm 214.

Heating element 212 and spray-arm 214 are aligned non-symmetrically, with the center of spray-arm 214, often the central hub 220, offset in relation to the center of heating element 212. This novel alignment maintains spray-arm 214 in varying locations with respect to heating element 212, at various times. In preferred embodiments, heating element 212 is rectangular, triangular, or asymmetric in shape.

During a typical washing or rinsing phase, a pump forces washing or rinsing liquid upwardly through a conduit and into spray-arm 214. The washing or rinsing liquid is distributed from spray-arm 214 by spray orifices 221. Spray-arm 214 is reactively driven by spray-orifices 221 disposed to discharge a jet stream in a direction such that spray-arm 214 reacts to the force of the discharge and rotates in a horizontal plane thereby achieving maximum washing or rinsing coverage. Upon completion of the washing or rinsing phase, spray-arm 214 stops in varied resting orientations, and the drying phase begins. For example, see FIGS. 3A–3D, resting orientations A–D.

Figure 3A:
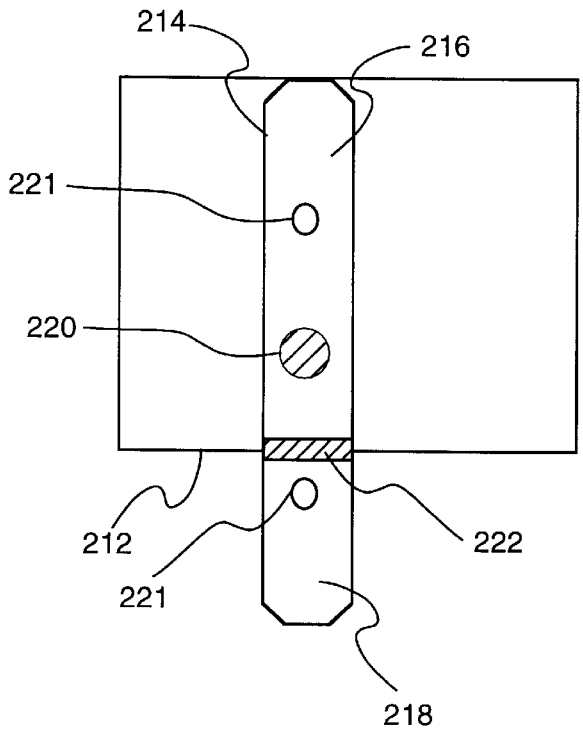
FIGS. 3A–3D are schematic illustrations of a top view of a non-symmetric heating element/spray-arm alignment, according to the instant invention.

In resting orientation A of FIG. 3A, spray-arm 214 is shown, with heated point 222 indicating the region of spray-arm 214 which is subjected to the high temperatures of heating element 212 when spray-arm 214 stops in this resting orientation.

Figure 3B:
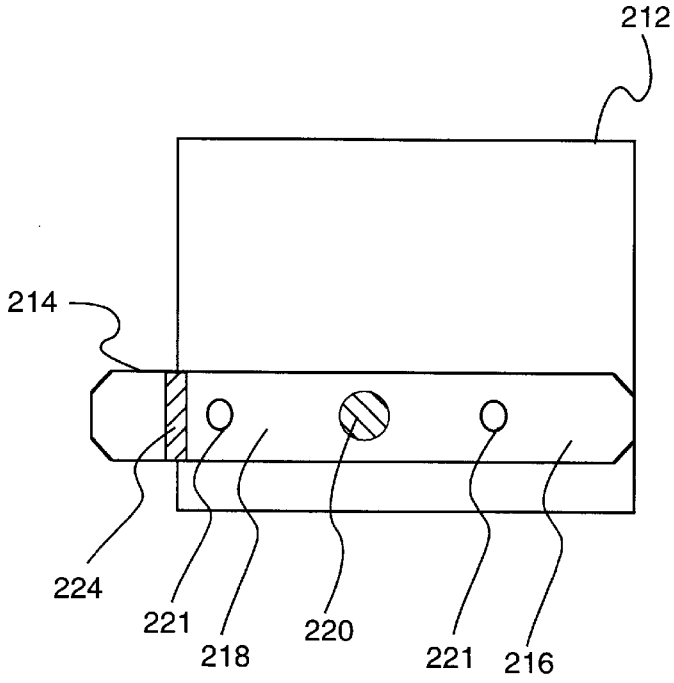

In resting orientation B of FIG. 3B, spray-arm 214 is shown rotated 90° clockwise from resting orientation A. Heated point 224 indicates the region of spray-arm 214 which is subjected to the high temperatures of heating element 212 when spray-arm 214 stops in this resting orientation.

Figure 3C:
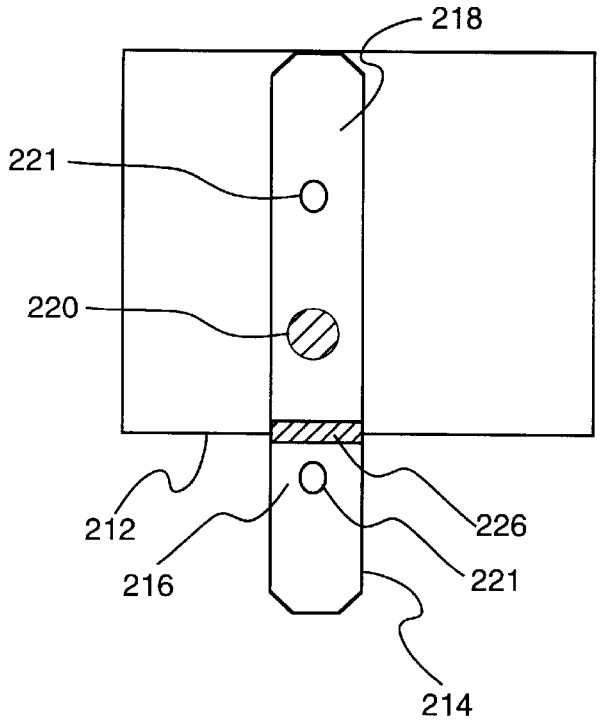

In resting orientation C of FIG. 3C, spray-arm 214 is shown rotated 90° clockwise from resting position B. Heated point 226 indicates the region of spray-arm 214 which is subjected to the high temperatures of heating element 212 when spray-arm 214 stops in this resting orientation.

Figure 3D:
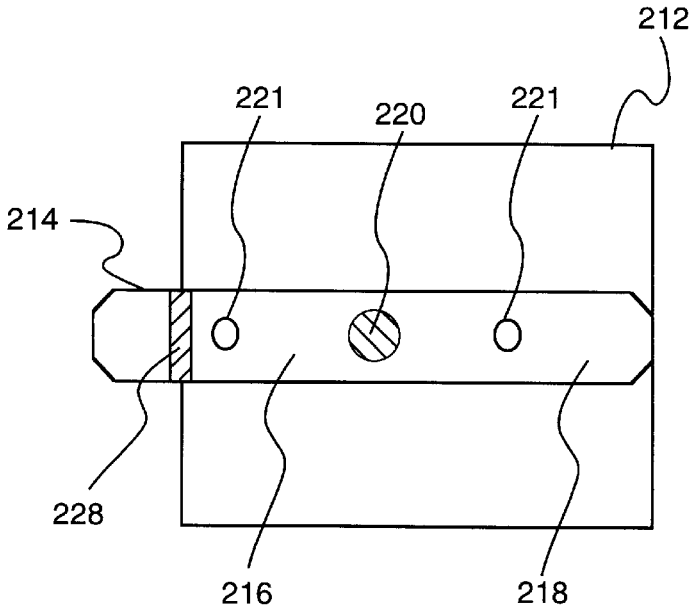

In resting orientation D of FIG. 3D, spray-arm 214 is shown rotated 90° clockwise from resting position C. Heated point 228 indicates the region of spray-arm 214 which is subjected to the high temperatures of heating element 212 when spray-arm 214 stops in this orientation.

Figure 4:
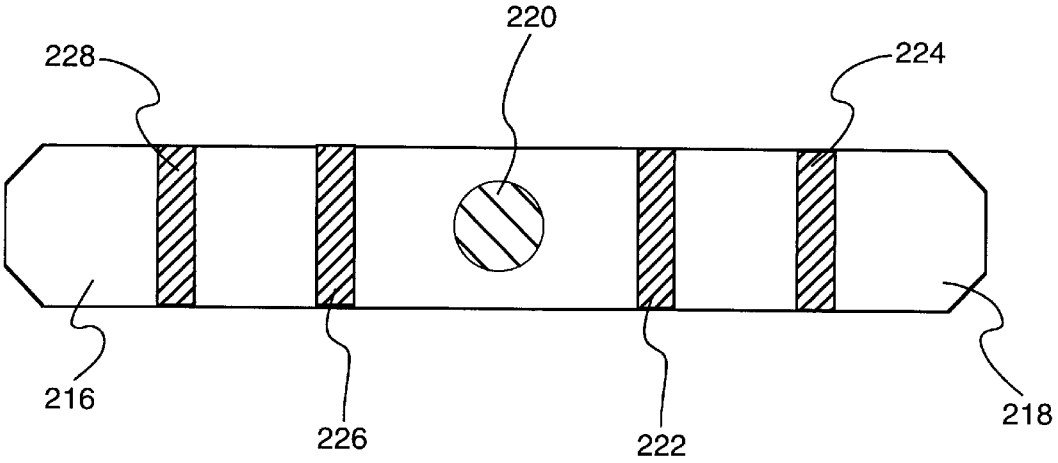
FIG. 4 is an exploded top view of the spray-arm and heated regions as shown in FIG. 3 of the drawings.

FIG. 4 is an exploded top view of spray-arm 214 and heated points, 222–228, as shown in FIG. 3. As shown, heated points 222, 224, 226, and 228 are spread out evenly over the surface of spray-arm 214. No isolated regions of spray-arm 214 are overexposed to heating element 212. By spreading the heating element exposure over almost the entire span of spray-arm 214, the life of spray-arm 214 is extended, the likelihood of part deterioration is lowered and the need for a protective heat shield is removed.

In a preferred embodiment, spray-arm 214 is made of a thermoplastic resistant to high temperatures. In a most preferred embodiment, spray-arm 214 is made of a talc-filled polypropylene polymer, often 20% talc-filled.

Figure 5:
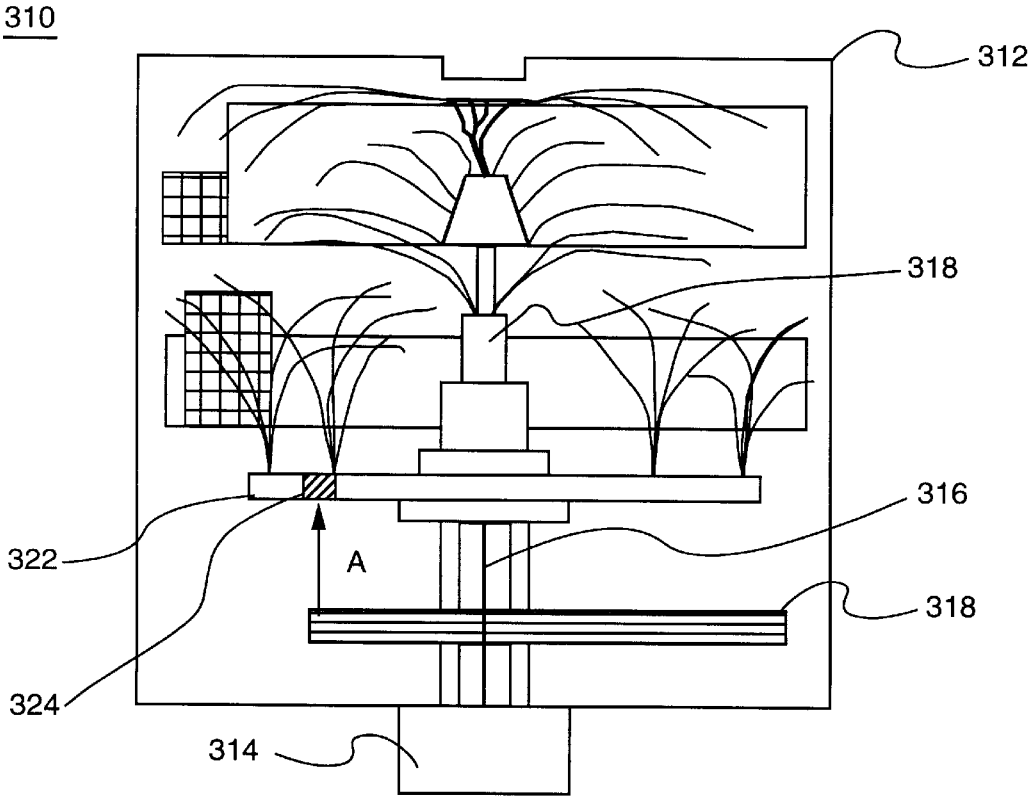
FIG. 5 is a frontal view of a dishwasher assemblage incorporating the non-symmetric heating element/spray-arm alignment of the instant invention.

FIG. 5 is a frontal view of a dishwasher assemblage incorporating the non-symmetric heating element/spray-arm alignment of the instant invention. Dishwasher assemblage 310 comprises conventional dishwasher tub 312, conventional dishwasher pump 314, conventional conduit 316, and a conventional water tower 318. Fixedly positioned at the bottom of said conventional dishwasher tub 312 is heating element 320. Spray-arm 322 is rotatably mounted within said conventional dishwasher tub 312 above said heating element 320.

Dishwasher assemblage 310 has a number of rinsing and washing phases and a final drying phase. During the washing or rinsing phase of dishwasher operation, conventional dishwasher pump 314 forces washing or rinsing liquid upwardly through conduit 316 to spray-arm 322 and to water tower 318. The washing or rinsing liquid is distributed from spray-arm 322 by spray orifices (not shown). Spray-arm 322 is reactively driven by the spray orifices, disposed to discharge a jet stream in a direction such that spray-arm 322 reacts to the force of the discharge and rotates in a horizontal plane thereby achieving maximum washing or rinsing coverage. When the washing phase is complete, spray-arm 322 comes to rest in varied resting orientations, and the drying phase begins.

During the drying phase of operation, region 324 of spray-arm 322 is subjected to the heat of heating element 320, along the path of arrow A.

However, due to the novel non-symmetric alignment of the spray-arm 322 and the heating element 320 within the instant invention, the regions of spray-arm 322 exposed to heating element 320, will vary according to different resting orientations of spray-arm 322 during drying phases of operation.

The foregoing has described a novel alignment of a heating element and a spray-arm within a dishwasher. While specific embodiments of the instant invention have been described, it will be apparent to those skilled in the art that various modifications thereto can be made without departing from the spirit and scope of the invention as defined in the appended claims.

We claim:

1. A dishwasher having a rinsing, a washing, and a drying phase comprising:

a spray-arm made of a talc-filled polypropylene polymer having a center point rotatably attached within said dishwasher, said spray-arm comprising a pair of radially extending wing sections and a central hub;

a rectangular heating element disposed asymmetrically around and in a spaced relation with said center point of said spray-arm such that different portions of said wing section are disposed in closest proximity to different portions of said rectangular heating element when said spray-arm is at rest;

a dishwasher pump; and a conduit fluidly connecting said spray-arm to said pump, wherein said pump forces liquid through said conduit to said spray-arm during said rinsing or said washing phase;

wherein said polymer spray-arm is heated by said heating element in various regions of said radially extending wing sections at various resting points due to the asymmetric alignment of said rectangular heating element with respect to said radially extending wing sections so as to avoid deterioration of said spray-arm due to being subjected to excessive heat and obviating the need for spray-arm heat shields.

* * * * *